US008096846B2

(12) United States Patent
Posner et al.

(10) Patent No.: US 8,096,846 B2
(45) Date of Patent: Jan. 17, 2012

(54) AUTO-FASTENING REMOVABLE FIN SYSTEM

(76) Inventors: Scott Posner, Delray Beach, FL (US); Chad Posner, Delray Beach, FL (US)

( * ) Notice: Subject to any disclaimer, the term of this patent is extended or adjusted under 35 U.S.C. 154(b) by 250 days.

(21) Appl. No.: 12/424,101

(22) Filed: Apr. 15, 2009

(65) Prior Publication Data

US 2010/0120305 A1 May 13, 2010

Related U.S. Application Data

(60) Provisional application No. 61/198,973, filed on Nov. 12, 2008.

(51) Int. Cl.
*B63B 1/00* (2006.01)

(52) U.S. Cl. ..... 441/79

(58) Field of Classification Search ..... 441/79; 24/645, 509, 538, 594.1, 599.7, 664, 614, 24/662; 403/321
See application file for complete search history.

(56) References Cited

U.S. PATENT DOCUMENTS 3,098,659 A * 7/1963 Shepler ..... 277/386
3,489,424 A * 1/1970 Gertsch et al. ..... 280/618
5,215,488 A * 6/1993 Bailey ..... 441/79
5,464,359 A 11/1995 Whitty
5,649,846 A 7/1997 Harper et al.
5,672,081 A 9/1997 Whitty
5,830,025 A 11/1998 Fleming
5,934,963 A 8/1999 Frizzell
6,485,080 B2 * 11/2002 Hansen et al. ..... 296/65.03
6,695,662 B2 * 2/2004 Kelley ..... 441/79
6,764,364 B1 7/2004 Hickman et al.
6,916,220 B2 7/2005 Davey et al.
6,991,504 B1 1/2006 English et al.
7,025,645 B1 4/2006 Hsieh
7,182,661 B2 2/2007 Sams et al.
2004/0214486 A1 10/2004 McCausland et al.

* cited by examiner

*Primary Examiner* — Stephen Avila
(74) *Attorney, Agent, or Firm* — Keith D. Nowak, Esq.; Carter Ledyard & Milburn LLP

(57) ABSTRACT

The auto-fastening skeg system comprises a skeg receiver and a skeg. The skeg has a male component that cooperates with a cavity of the skeg receiver. The cavity has front and rear ends, a spring disposed at said front end and at least one dowel disposed between the front and rear ends. The male component includes a front tip and at least one locking wedge, said locking wedge corresponds in number to the number of dowels. When the male component is set in the cavity and the locking wedge is aligned with the dowel of the receiver, the spring pushes the front tip of the male component against the rear wall of the cavity of the receiver and the locking wedge against the dowel providing a locking mechanism that holds the skeg to the receiver.

12 Claims, 9 Drawing Sheets

AUTO-FASTENING REMOVABLE FIN SYSTEM

PRIORITY AND RELATED APPLICATION

This application claims priority to U.S. Provisional Patent Application Ser. No. 61/198,973, filed Nov. 12, 2008, entitled "AUTO-FASTENING REMOVABLE MODULAR CONTROL SURFACE FOR WATERCRAFT," which is hereby incorporated by reference in its entirety.

FIELD OF THE INVENTION

The present invention relates to removable fins or skegs for use with water sports devices.

BACKGROUND OF THE INVENTION

Most water craft devices include one or more fins for stability and control. The devices themselves are frequently of a foam core with laminate such as fiberglass with a laminating resin covering and sealing the core. Typically the fiberglass or wooden fins have been added to the device after it has been laminated. The fins are typically glued right to the surface of the device and then reinforcing fiberglass patches are laminated to the device and the sides of the fins for strength. Fiberglass roving is also positioned to either side of the fin to increase the radius of the fillets for added strength. More recently, fin mounting systems have been positioned into the foam core and bonded to the device.

Fin mounting systems (mounting boxes) that allow the removal of fins have been a common feature of devices such as surfboards for a number of years. This feature provides several benefits, for example, broken fins can be easily replaced, fins of different designs can be used interchangeably on the same board, and fins can be easily removed for storage or transportation to save space and reduce the risk of breakage. Existing designs require some form of tool to install or remove fins, which is a significant drawback.

BRIEF SUMMARY OF THE INVENTION

The auto-fastening skeg system comprises a skeg receiver and a skeg. The skeg has a male component that is removably attachable to a cavity of the skeg receiver. The cavity has front and rear ends, a spring disposed at said front end and at least one dowel disposed between the front and rear ends. The male component includes a front tip and at least one locking wedge, said locking wedge corresponds in number to the number of dowels. When the male component is set in the cavity and the locking wedge is aligned with the dowel of the receiver, the spring pushes the front tip of the male component against the rear wall of the cavity of the receiver and the locking wedge against the dowel providing a locking mechanism that holds the skeg to the receiver. The dowel slides into an opening of the locking wedge and is secured in placed by a slope disposed by the opening of the locking wedge. The skeg may be disengaged from the receiver by pushing the skeg against the force of the spring and uncoupling the dowel from the opening of the locking wedge allowing the dowel to slide past the slope and out of the opening of the locking wedge and pulling the skeg out of the cavity.

DETAILED DESCRIPTION OF THE INVENTION

Figure 1:
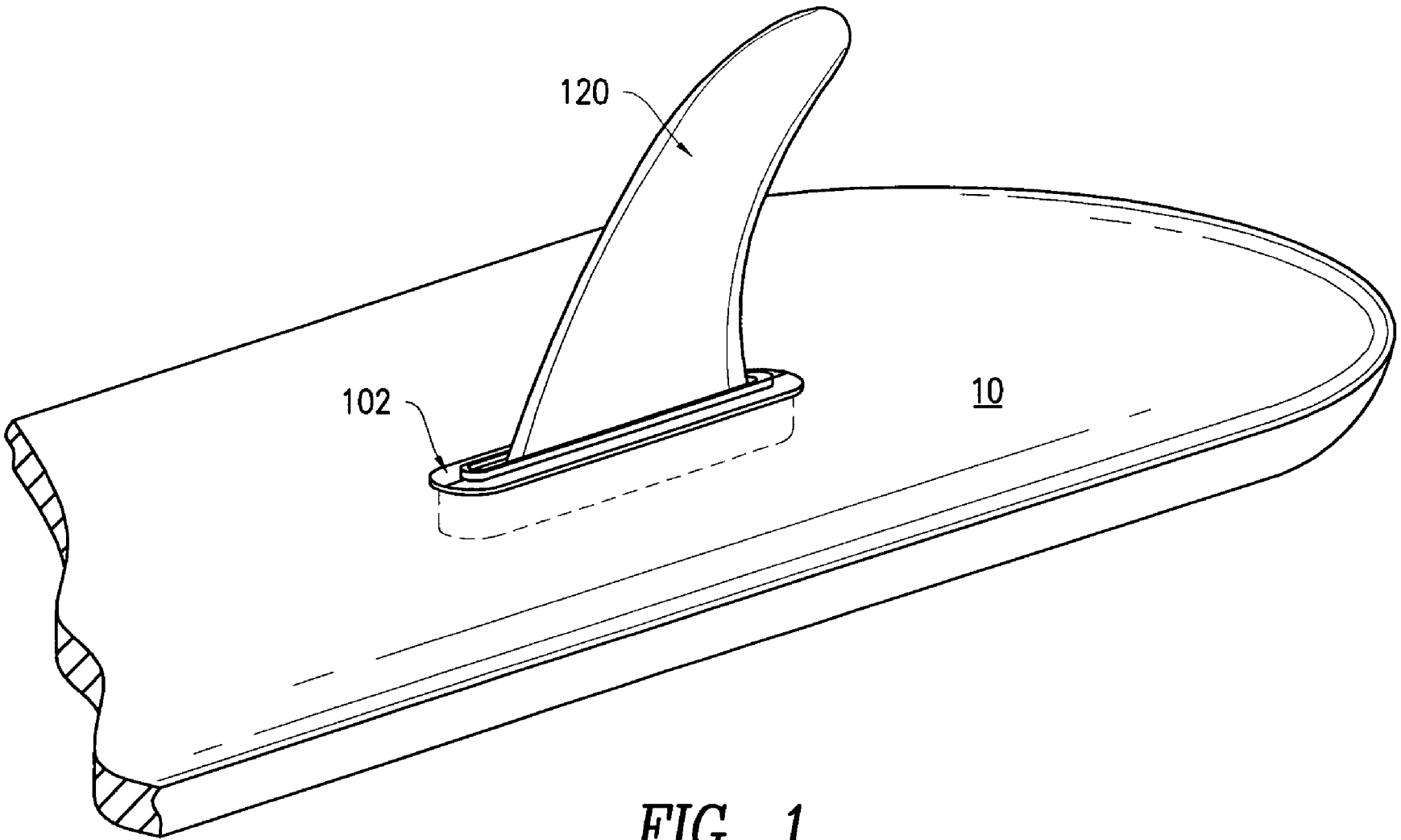
FIG. 1 is a perspective view of the removable fin system of the present invention disposed on a watercraft device.

Referring now to the drawings where similar parts are identified by like reference numerals, FIG. 1 shows a preferred embodiment of an auto-fastening removable fin system 100 of the present invention disposed on a watercraft device 10. The watercraft device 10 may be a ocean wave surfing apparatus, surfboard or similar device. The system comprises a receiver 102 and skeg or fin 120. The skeg 120 is designed to enhance stability and control of the watercraft 10. In the system 100 of the present invention, the skeg 120 is detachable from the receiver 102 for convenience of travel, easy replacement in case of breakage, and modular capabilities.

Figure 2A:
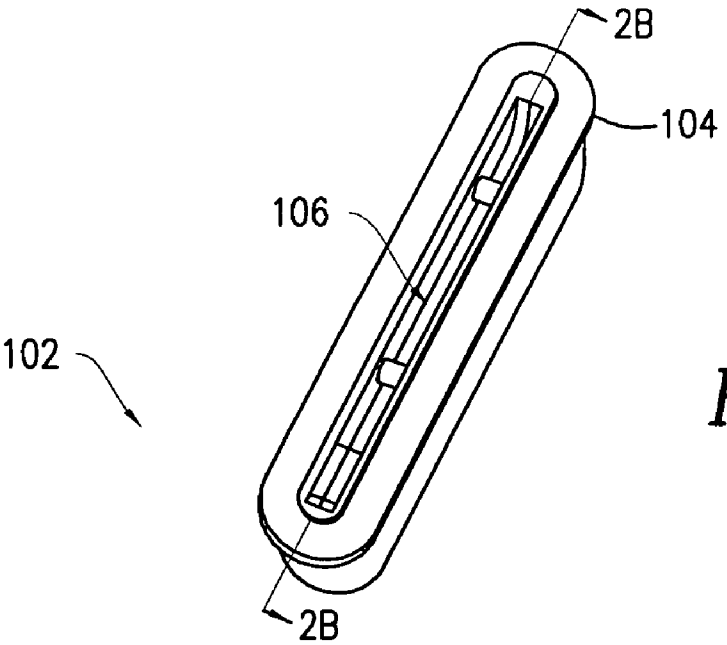
FIG. 2A is an side elevational view of a receiver of the system of the present invention.
Figure 2B:
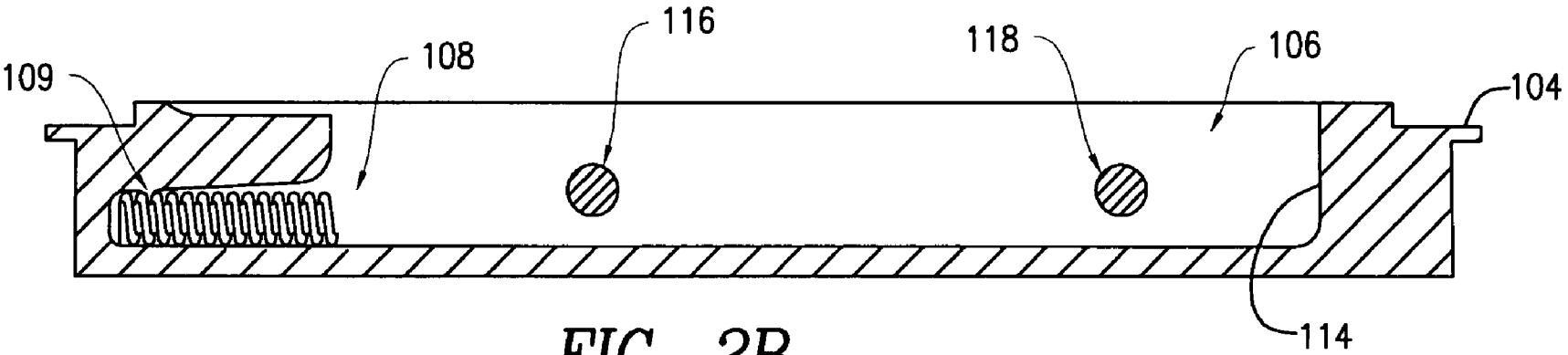
FIG. 2B is a view of the receiver of FIG. 2A taken along lines 2B-2B.

Referring now to FIGS. 1, 2A and 2B, the receiver 102 has a shoulder surface or lip 104, which is intended to sit below the top surface of the watercraft 10. The receiver 102 is permanently and rigidly retained in an opening on the watercraft 10 with a resin and woven fabric composite. Composite material covers the lip 104 to better retain the receiver 102 and prevent dislodging the receive 102 from the watercraft 10.

The receiver 102 forms a female housing including an elongated cavity 106 with a front end and a rear wall 114. An overhang portion 110 is disposed at the front end of the cavity 106 with a stainless steel preloaded compression spring 108 being retained inside the overhang 110 for example, by a small tab 109. In one embodiment, a first dowel 116 is disposed near the overhang 110 and a second dowel 118 disposed near the rear wall 114. The embodiment shown in FIGS. 1-4D has two stainless steel dowels 116, 118, however more or less dowels may be employed as will be discussed below.

Figure 3:
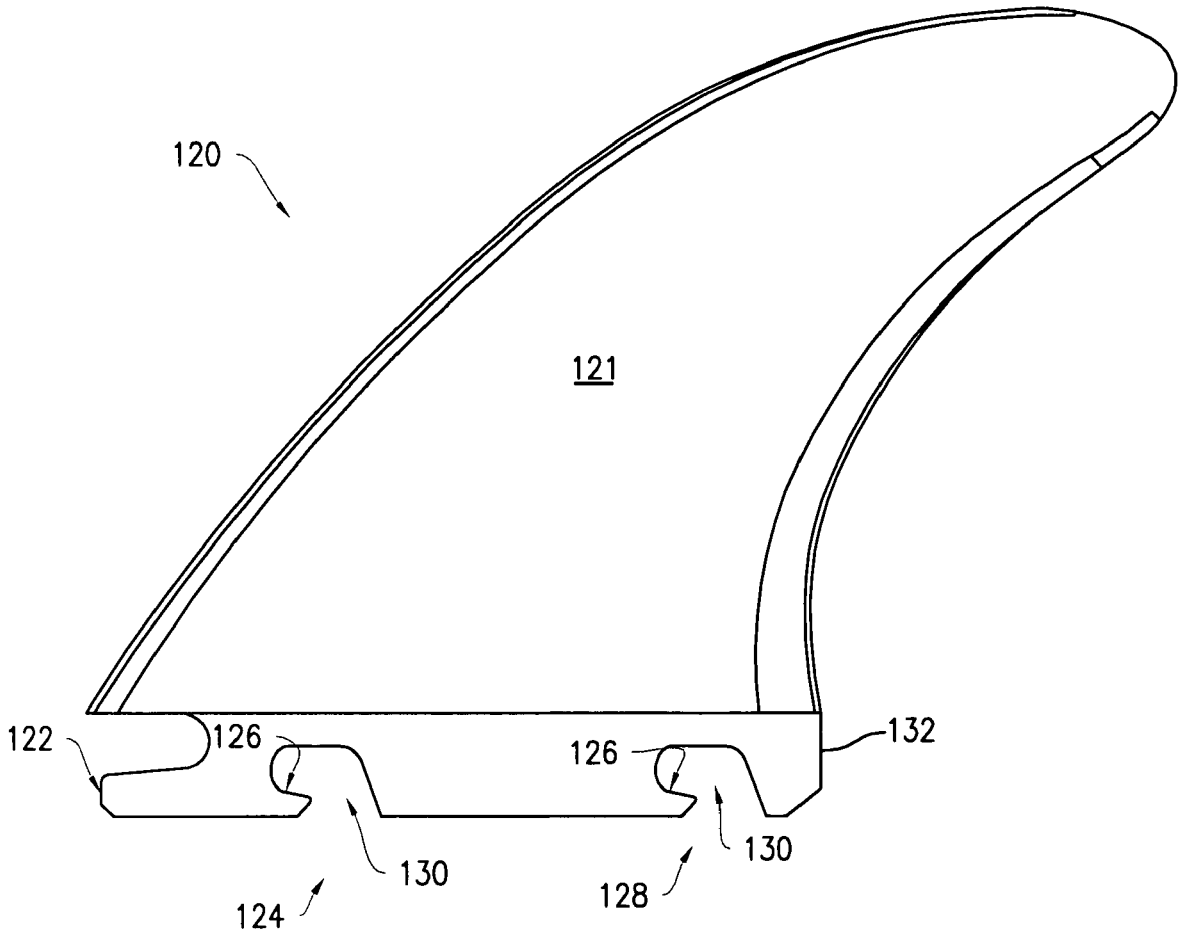
FIG. 3 is a view a fin of the system of the present invention.

FIG. 3 shows the skeg 120 of the system 100 having a control surface 121 and a male component disposed at the bottom surface of the skeg 120. The male component is intended to cooperate with the female housing of the receiver 102. The male component includes a front tip 122, a first locking wedge 124, a second locking wedge 128 and a rear edge 132. Each locking wedge 124, 128 has a sloped area 126 and an opening 130 dimensioned and configured to receive the dowel 116, 118.

Figure 4A:
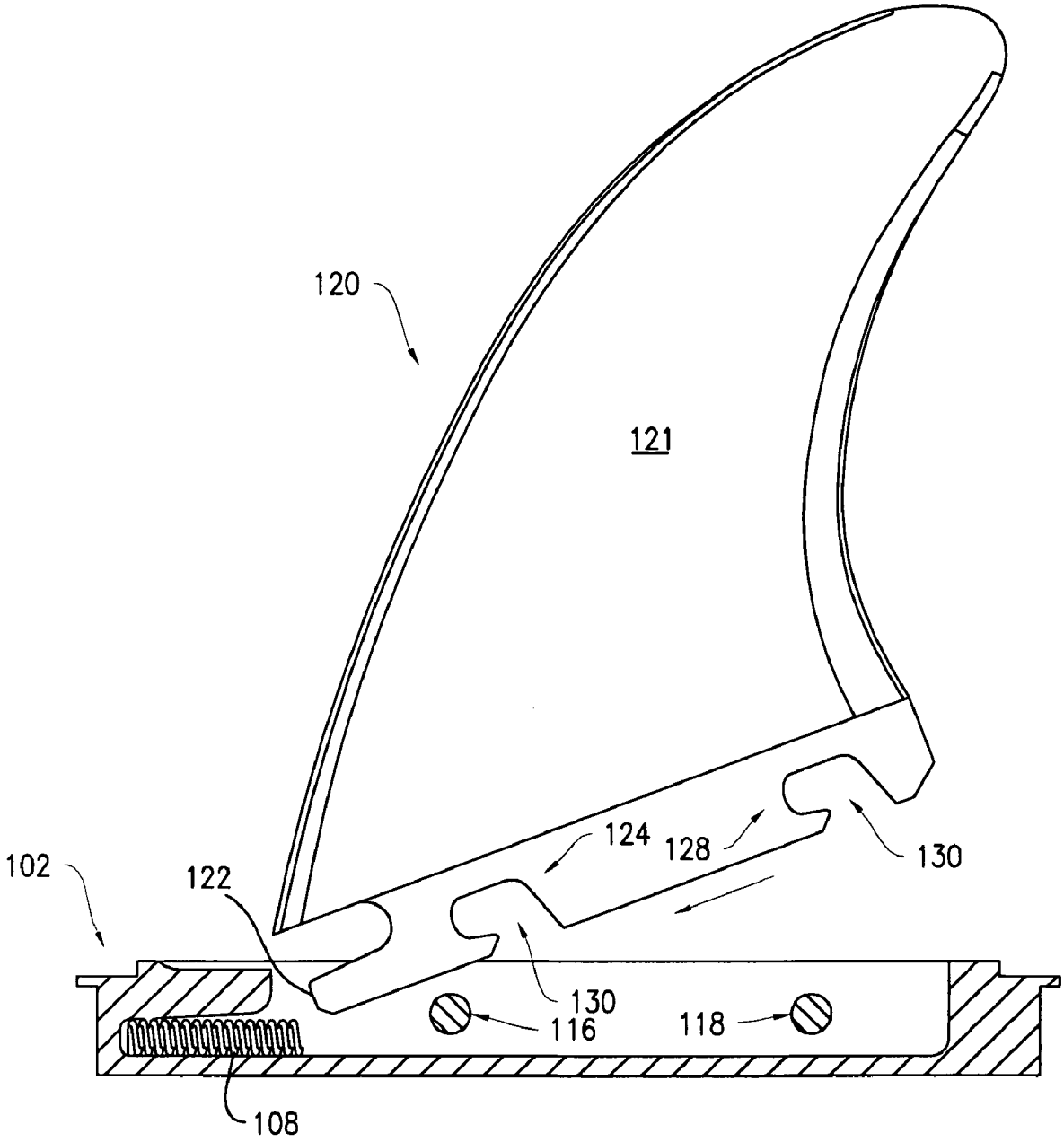
FIGS. 4A-4D shows the insertion of the fin into the receiver.
Figure 4B:
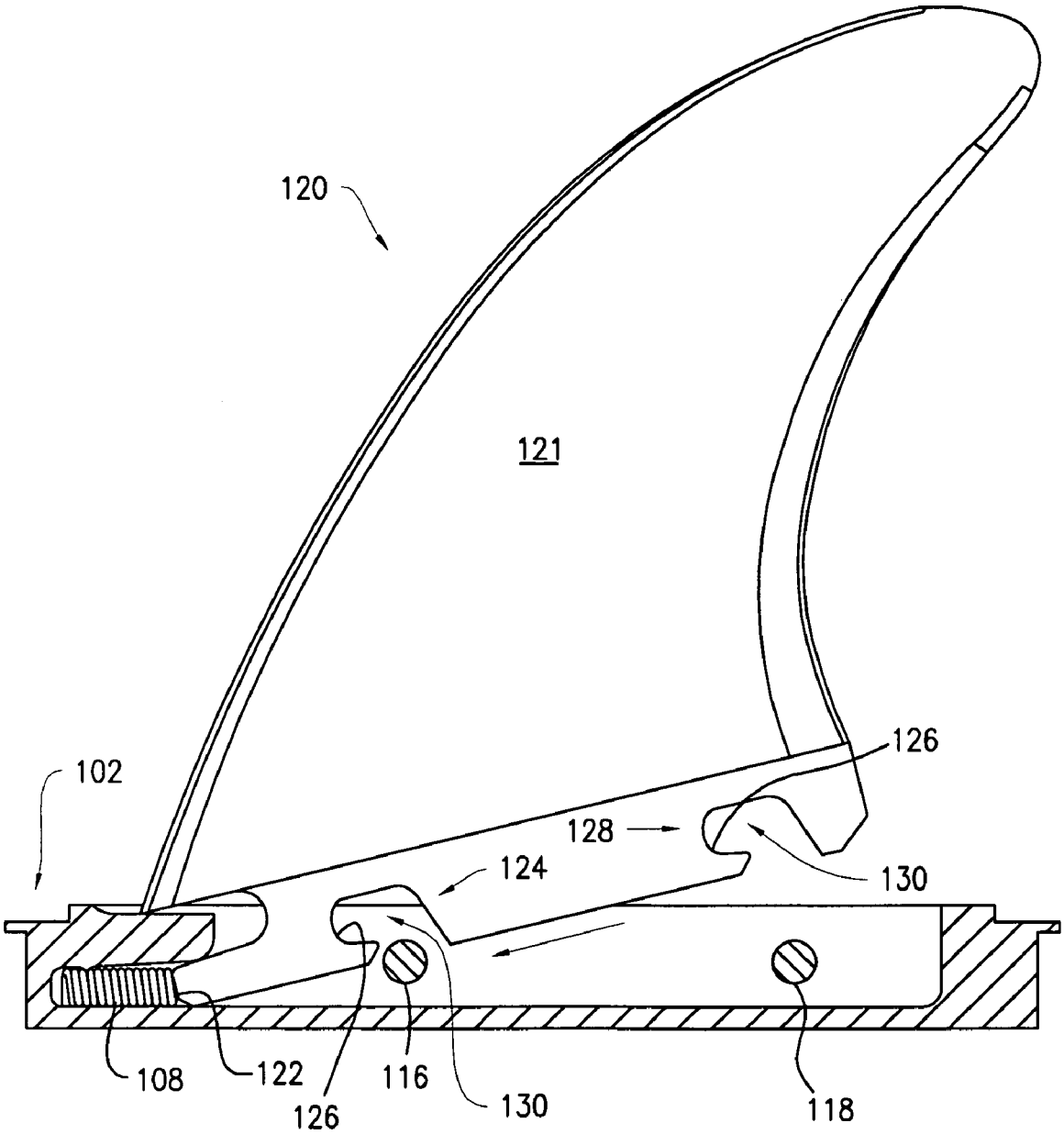
Figure 4C:
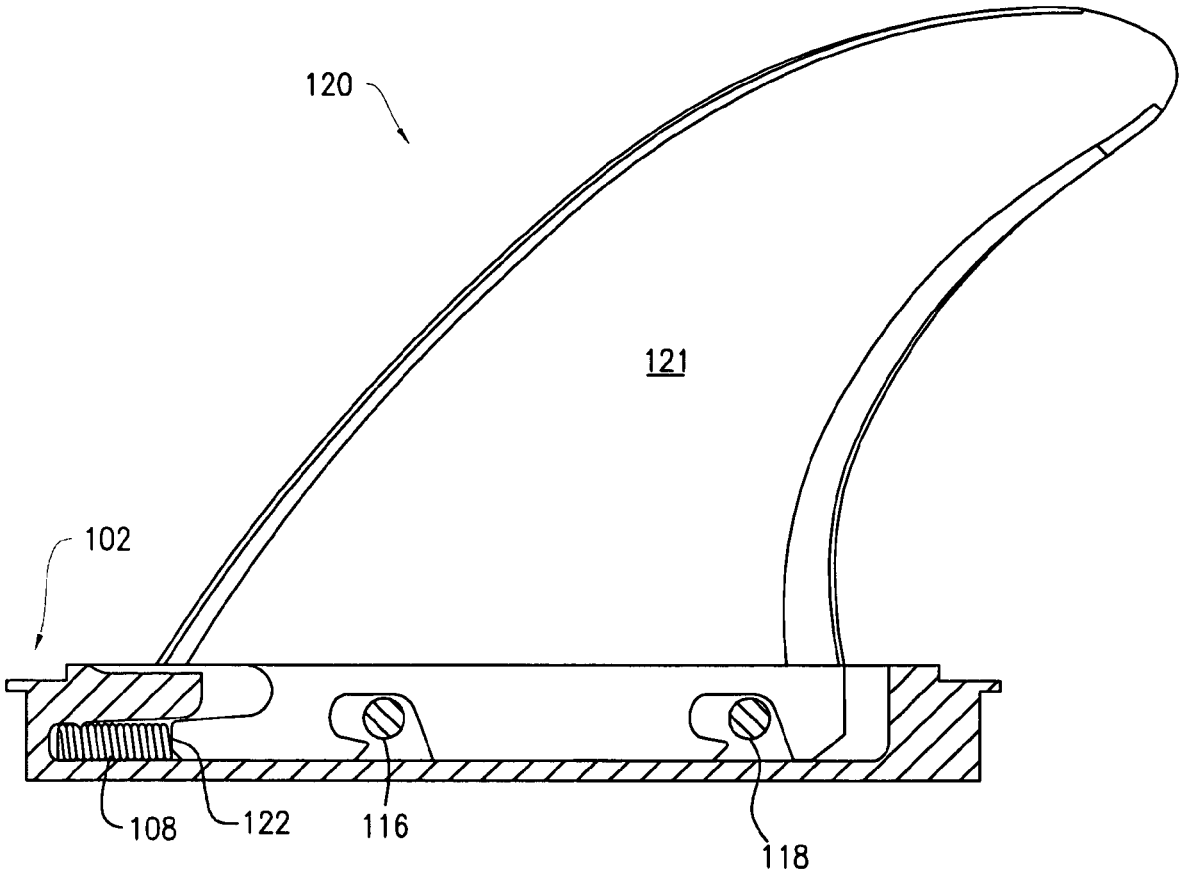
Figure 4D:
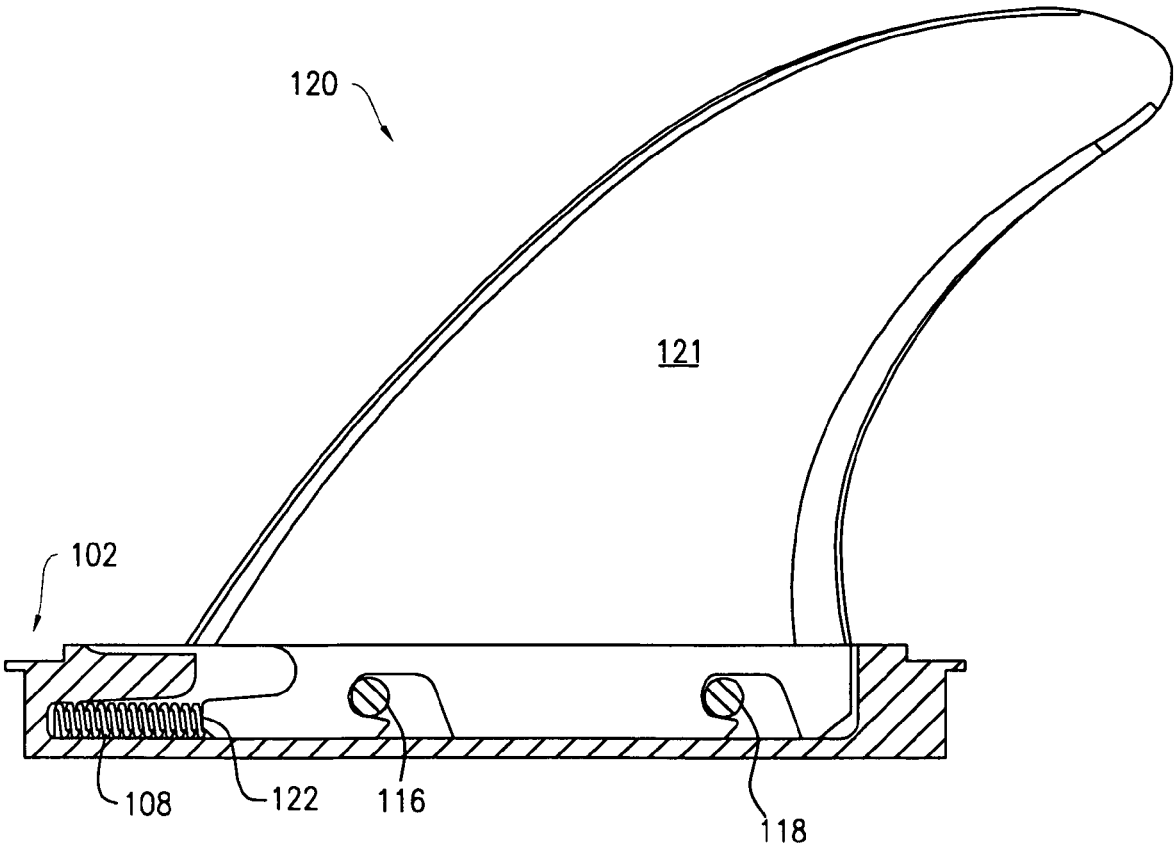

Referring now to FIGS. 4A-4D, the system 100 of the present invention is shown where the skeg 120 connects with the receiver 102. Referring to FIG. 4A the front tip 122 of the skeg 120 is inserted into the cavity 106 of the receiver 102 at a downward angle directed toward the spring 108. The front tip 122 of the skeg 120 will begin to compress the spring 108 until the sloped area 126 of the locking wedges 124, 128 are ahead of the dowels 116, 118, respectively. See FIG. 4B. Once the opening 130 of the locking wedges 124, 128 are aligned with the dowels 116, 118, the skeg 120 can be rotated or pivoted downward until the skeg 120 is sitting within the cavity 106 of the receiver 102 and the dowels 116, 118 are slide into the opening 130 of the locking wedge 124, 128, see FIG. 4C. The compression loaded spring 108 then pushes the skeg 120 back toward the rear wall 114 thereby allowing the locking wedges 124, 128 to engage the dowels 116, 118, see FIG. 4D. Specifically, the dowels 116, 118 slide into the opening 130 and are held in position by the sloped area 126 which, in this engaged position, is aligned with the dowels 116, 118 to hold the skeg 120 within the receiver 102. The compression force created by the spring 108 thereby holds the skeg 120 in place by pushing the skeg 120 to the rear wall of the cavity 106 and also pushing the locking wedges 124, 128 to engage the dowels 116, 118. The elongated shape of the receiver 102 prevents rotation of the skeg 120 therefore increasing rigidity.

When installed, both the slope 126 and the spring 108 work concurrently to keep the skeg 120 in place. The small slope 126 on the locking wedges 124, 128 provide a downward force to aid in locking the skeg 120 to the receiver 102. The slope 126 prevents the skeg 120 from being dislodged by a vertical force or pulling action and thus retains the skeg regardless of vertical force. See FIG. 4D. The pre-loaded spring 108 provides a consistent horizontal holding force or lateral force to prevent disengagement of the skeg 120 from the receiver 102 while in normal use. See FIG. 4D.

The skeg 120 is easily removed by reversing the installation steps. For instance, the skeg 120 is pushed toward the front end of the receiver 102 thereby compressing the spring 108, the locking wedges 124, 128 are then uncoupled from the dowel 116, 118 allowing the dowels 116, 118 to exit the opening 130 of the wedges 124, 128 and thus permitting the user to lift the skeg 120 up and out of the cavity 106 of the receiver 102.

When the receiver 102 is not in use and the skeg 120 is not attached, the spring 108 is retained inside the receiver 102 by the tab 109 that is engaged to a coil on the spring 108. The dowels 116, 118 and spring 108 are used in conjunction with each other to create the locking action or a locking means of the system 100. These components provide the ability to rigidly attach the skeg 120 to the receiver 102 without using any tools, such as screwdrivers or wrenches, and fixings such as screws or bolts. The system 100 of the present invention creates an easily removable and attachable skeg 120. For instance the skeg 120 may be removed for storage, travel, and modular design to be interchanged with skegs 120 for different applications or water conditions. The system 100 provides convenience and flexibility to the user by allowing skegs 120 to be interchangeably used with the one receiver 102 design.

The receiver 102 may be made of tough, durable material such as chemically inert plastic or similar material for ease of manufacturing and long life cycle. Different grades can be used to achieve different levels of performance due to differences in stiffness of the grade. All materials are intended to be corrosion resistant and durable to ensure a long life cycle. This invention can be made easily via the injection molding techniques. The receiver 102 may be of any size and can be scaled for use with other applications. A preferred size for surfing application is 6.5"×1.5"×0.75" and the skeg 120 would be dimensioned appropriately thereto.

Figure 5:
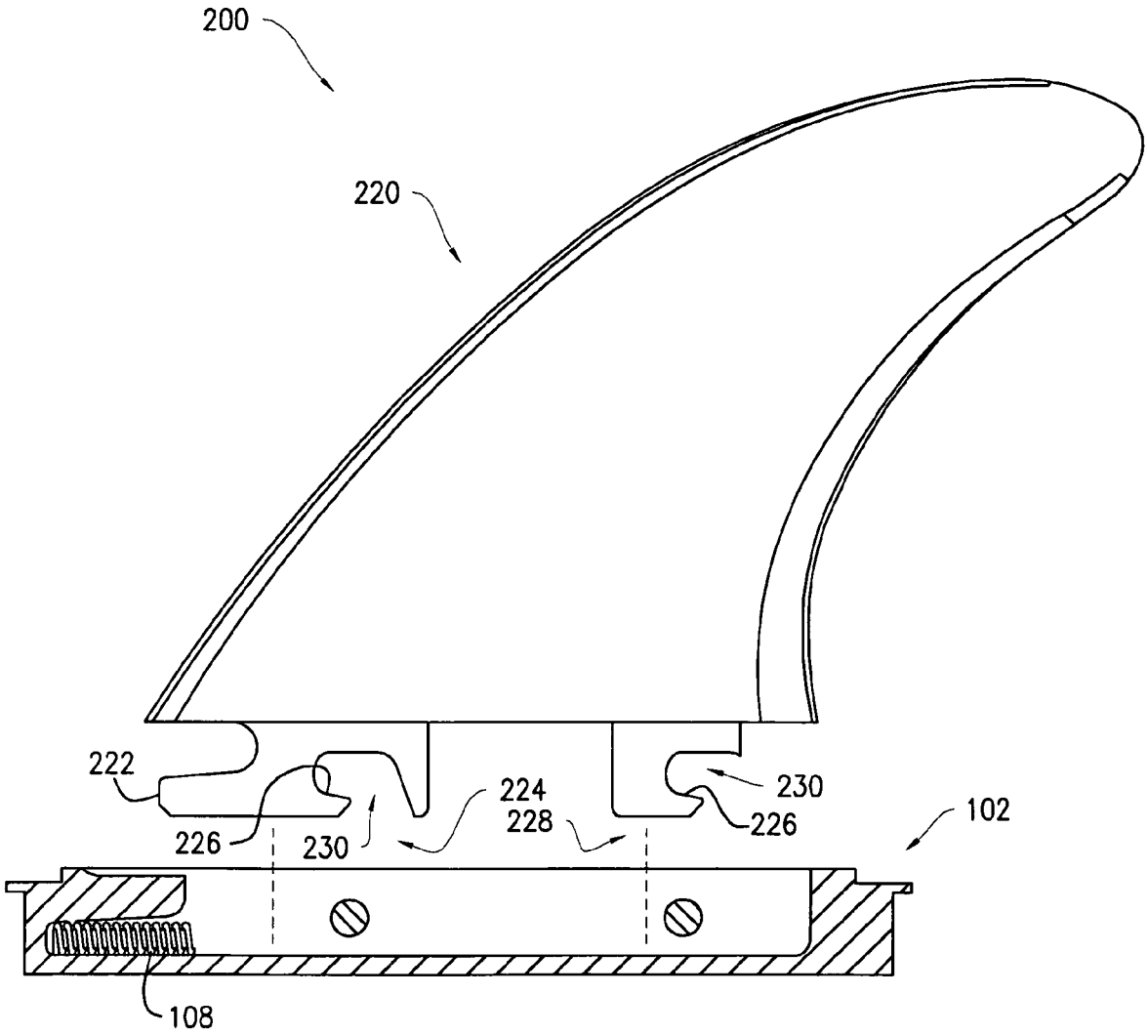
FIG. 5 shows an alternative locking embodiment of the system of the present invention wherein a skeg is exploded from a receiver.

FIGS. 1-4D show a preferred embodiment with two dowel and two locking wedges. Other embodiments may also employed with modifications being made to the male component of the skeg 120 and/or female housing of the receiver 102 while keeping the installation of the skeg with the receiver the same. For instance, in an embodiment the male component of the skeg 220 may be modified wherein one of the two locking wedges 224, 228 has a different shape than the locking wedges 124, 128 of skeg 120 as shown in alternative skeg embodiment 220 of FIG. 5. Here the male component of the skeg 220 includes a first locking wedge 224 similar to locking wedge 124 of the preferred embodiment. The second locking wedge 228 has a sloped area 226, an opening 230 and is open-backed. The skeg 220 would be able to cooperate with the receiver 102 of the preferred embodiment shown in FIGS. 1-4D. Alternatively, the cavity 106 of the receiver 102 could be modified to have two independent cavities (not shown) to cooperate with independent first and second locking wedges 224, 228 of the skeg 220. The present invention should not be limited to the number of locking wedges as more than two locking wedges and thus cavities for each locking wedge could be employed in the present invention.

Figure 6:
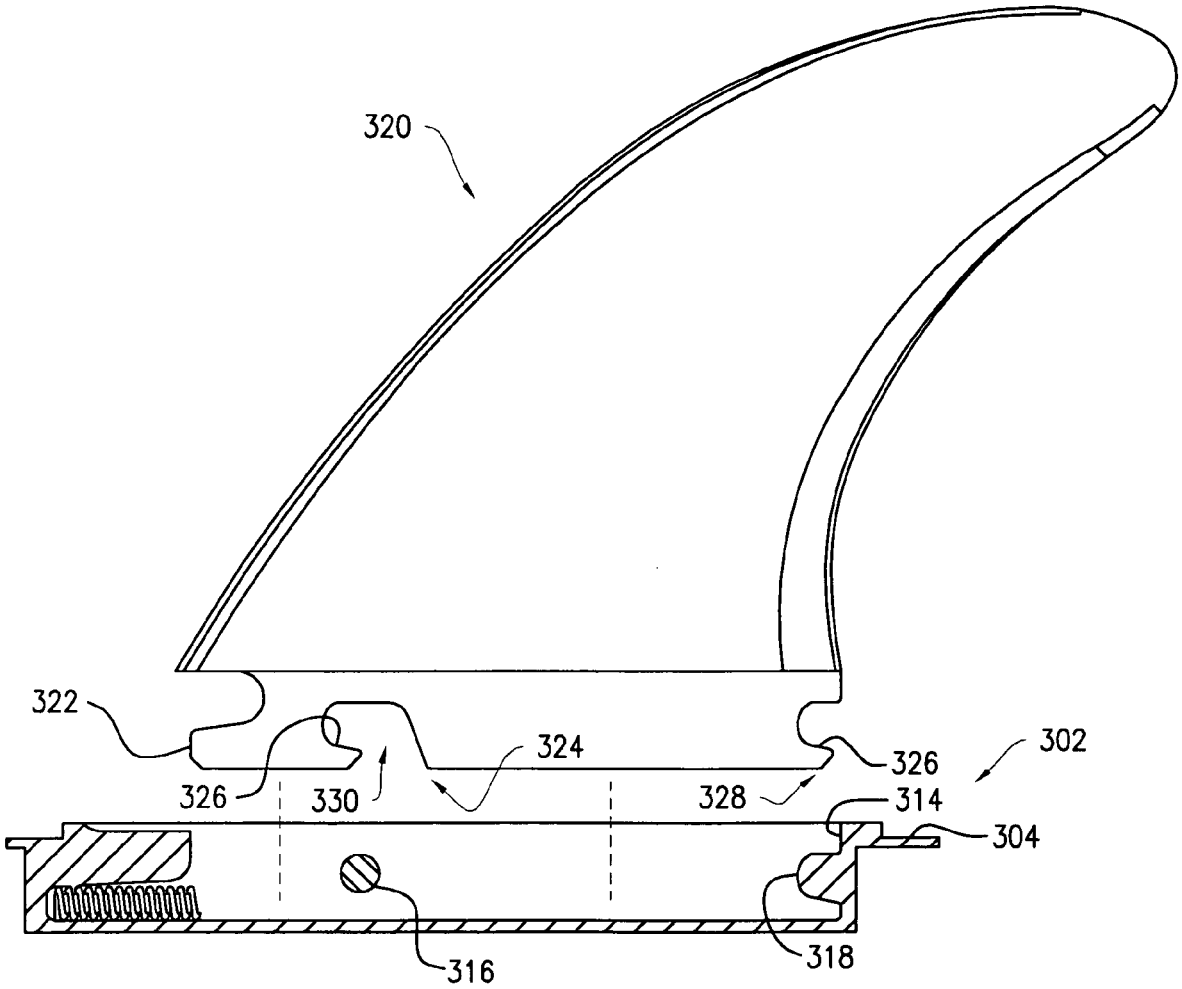
FIG. 6 shows another alternative locking embodiment of the system of the present invention wherein a skeg is exploded from a receiver.

In another embodiment, both the male component of the skeg and the female housing of the receiver can be modified. FIG. 6, shows another alternative skeg embodiment 320. Here the male component of the skeg 320 includes a first locking wedge 324 similar to locking wedge 124 of the preferred embodiment. The second locking wedge 328 has a sloped area 326, an opening 330 which is open-backed. The receiver 320 would have to be modified to work with the skeg 320 wherein the rear wall 314 would have a projection 318 that would be dimensioned and configured to receive the opening 330 of the second locking wedge 328. In this embodiment, the dowel 316 and projection 318 along with the spring 108 are used in conjunction with each other to create the locking action or a locking means.

While the invention has been described by way of example and in terms of specific embodiments it is not so limited and is intended to cover various modifications as would be apparent to those skilled in this art area. Therefore, the scope of the appended claims should be accorded the broadest interpretation so as to encompass all such modifications.

We claim:

1. An auto-fastening skeg system comprising:

a skeg having at least one male component, said male component including a front tip, and at least one locking wedge, said locking wedge having an opening, a skeg receiver having a cavity with a front end and a rear end, said receiver having a spring disposed at said front end, and at least one dowel disposed between the front end and the rear end, said front tip of the skeg being dimensioned and configured to abut the spring;

wherein the male component is releasably attachable to the cavity, and wherein when the skeg is disposed in the receiver said spring pushes the skeg toward the rear end of the receiver thereby engaging the locking wedge of the male component with the dowel included within the cavity of the skeg receiver.

2. The auto-fastening skeg system of claim 1, wherein the spring is compression loaded.

3. The auto-fastening skeg system of claim 1, wherein the skeg has a bottom surface, said male component being disposed at the bottom surface.

4. The auto-fastening skeg system of claim 1, wherein the locking wedge has a slope adjacent the opening.

5. The auto-fastening skeg system of claim 1, wherein the receiver further comprises a projection, said projection being designed to cooperate with the locking wedge, wherein when the skeg is disposed in the receiver in said engaged position the projection is disposed in said opening of said locking wedge and said locking wedge is pushed against the projection.

6. The auto-fastening skeg system of claim 5, wherein the projection is disposed at said rear wall of said cavity.

7. A method of operating a skeg and a skeg receiver comprising:

providing a skeg having a male component including a front tip and at least one locking wedge, said locking wedge having an opening;

providing a receiver having a cavity with a front end and a rear end, said receiver having a spring disposed at said front end and a at least one dowel disposed between the front end and the rear end;

inserting the front tip of the skeg into the front end of the cavity thereby compressing the spring;

maneuvering the skeg downward into the cavity allowing the dowel to slide into the locking wedge; and releasing the skeg thereby allowing the spring to push the front tip of the skeg toward the rear wall of the cavity and allowing the dowel to sit within the locking wedge.

8. The method of claim 7, wherein the locking wedge has a slope adjacent the opening, said slope retaining the dowel inside the opening regardless of vertical or lateral forces.

9. The method of claim 7, wherein when the skeg is maneuvered downward the dowel slides into the opening of the locking wedge and said spring pushes the locking wedge of the skeg against the dowel.

10. The method of claim 7, wherein the spring is compression loaded.

11. The method of claim 7, wherein the locking wedge corresponds in number to the dowel of the receiver.

12. The method of claim 7, further comprising disengaging the skeg from the receiver by pushing the skeg toward the front end of the receiver thereby compressing the spring and disengaging the locking wedge from the dowel and the lifting the skeg up and out of the cavity of the receiver.

* * * * *